US010726859B2

(12) United States Patent
Dahl et al.

(10) Patent No.: US 10,726,859 B2
(45) Date of Patent: Jul. 28, 2020

(54) METHOD OF AND SYSTEM FOR NOISE SUPPRESSION

(71) Applicant: NEXTLINK IPR AB, Malmö (SE)

(72) Inventors: Jonas Amtoft Dahl, Hellerup (DK); Asger Ertmann Hansen, Copenhagen S (DK); Anders Brøndal, Dyssegård (DK); Jan Larsen, Smørum (DK)

(73) Assignee: INVISIO COMMUNICATION A/S, Hvidovre (DK)

( * ) Notice: Subject to any disclaimer, the term of this patent is extended or adjusted under 35 U.S.C. 154(b) by 0 days.

(21) Appl. No.: 15/774,413

(22) PCT Filed: Nov. 9, 2016

(86) PCT No.: PCT/EP2016/077158
§ 371 (c)(1),
(2) Date: May 8, 2018

(87) PCT Pub. No.: WO2017/081092
PCT Pub. Date: May 18, 2017

(65) Prior Publication Data

US 2018/0336911 A1 Nov. 22, 2018

(30) Foreign Application Priority Data

Nov. 9, 2015 (DK) ..... 2015 70723

(51) Int. Cl.
*G10L 21/0232* (2013.01)
*G10L 21/0208* (2013.01)
(Continued)

(52) U.S. Cl.
CPC ..... *G10L 21/0232* (2013.01); *G10L 21/0208* (2013.01); *H04R 3/04* (2013.01);
(Continued)

(58) Field of Classification Search
CPC . G10L 2021/02165; G10L 2021/02168; G10L 21/0208; G10L 21/0232; H04R 3/04
(Continued)

(56) References Cited

U.S. PATENT DOCUMENTS

RE38,405 E * 1/2004 Clair, Jr. ..... H04R 5/00 381/79
2007/0088544 A1 4/2007 Acero
(Continued)

FOREIGN PATENT DOCUMENTS

| | | |
|---|---|---|
| EP | 1 638 084 A1 | 3/2006 |
| EP | 2 458 586 A1 | 5/2012 |
| WO | WO 97/10586 A1 | 3/1997 |

OTHER PUBLICATIONS

Yusuke, T. et al., "Noise suppression method for body-conducted soft speech enhancement based on external noise monitoring," 2016 IEEE International Conference on Acoustics, Speech and Signal Processing, Mar. 20, 2016, pp. 5935-5939 (6 pages).
(Continued)

*Primary Examiner* — Paul Kim
*Assistant Examiner* — Friedrich Fahnert
(74) *Attorney, Agent, or Firm* — Nixon Peabody LLP

(57) ABSTRACT

A method and system for noise suppression of a sound signal. The sound signal includes speech of a user while speaking. The system includes a first sound receiver that obtains a first sound signal and a second sound receiver that obtains a second sound signal. The first sound signal includes a first airborne noise signal when noise is present and a first airborne speech signal when the user is speaking. The second sound signal includes a second airborne noise signal when noise is present and a second airborne speech signal when the user is speaking. The first sound receiver is a vibration pickup or transducer that obtains an additional speech signal when the user is speaking. The additional
(Continued)

speech signal is obtained in response to vibrations propagating through the user, the vibrations being caused by the user speaking, and the first sound signal includes the additional speech signal when the user is speaking. The system is adapted to suppress, during use, at least a part of the first airborne noise signal, when present, in the first sound signal.

39 Claims, 3 Drawing Sheets

(51) Int. Cl.
*H04R 3/04* (2006.01)
*G10L 21/0216* (2013.01)

(52) U.S. Cl.
CPC ..... *G10L 2021/02165* (2013.01); *G10L 2021/02168* (2013.01)

(58) Field of Classification Search
USPC ..... 381/17, 71.1, 73.1, 94.2, 94.3, 110
See application file for complete search history.

(56) References Cited

U.S. PATENT DOCUMENTS

2007/0297620 A1* 12/2007 Choy ..... G10K 11/178 381/73.1
2010/0310084 A1 12/2010 Hersbach
2011/0026722 A1* 2/2011 Jing ..... G10L 21/0208 381/71.1
2011/0135106 A1 6/2011 Yehuday
2011/0293109 A1* 12/2011 Nystrom ..... G10L 21/038 381/94.2
2013/0070935 A1 3/2013 Hui
2014/0029762 A1 1/2014 Xie
2014/0081631 A1 3/2014 Zhu
2015/0199950 A1* 7/2015 Heiman ..... G10K 11/002 381/71.1
2016/0112811 A1* 4/2016 Jensen ..... H04R 5/033 381/17
2016/0134956 A1* 5/2016 Tan ..... H04R 3/005 381/110

OTHER PUBLICATIONS

Zicheng, L. et al., "Leakage model and teeth clack removal for air- and bone-conductive integrated microphones," 2005 IEEE International Conference on Acoustics, Speech, and Signal Processing, vol. , Mar. 18, 2005, pp. 1093-1096 (4 pages).
International Search Report in International Patent Application No. PCT/EP2016/077158, dated Jan. 16, 2017 (4 pages).
Written Opinion in International Patent Application No. PCT/EP2016/077158, dated Jan. 16, 2017 (12 pages).
International Preliminary Report on Patentability in International Patent Application No. PCT/EP2016/077158, dated Nov. 17, 2017 (24 pages).

* cited by examiner

METHOD OF AND SYSTEM FOR NOISE SUPPRESSION

FIELD OF THE INVENTION

The present invention relates generally to a noise suppression system for (and method of) noise suppression of a sound signal, the sound signal comprising speech of a user (potentially including noise) when the user is speaking, wherein the system comprises at least one first sound receiver adapted to obtain, during use, a first sound signal, and at least one second sound receiver adapted to obtain, during use, a second sound signal.

BACKGROUND OF THE INVENTION

For many sound-related applications, it is generally known and desired to apply noise suppression (or noise reduction) in audio or sound signals, e.g. comprising a speech signal part (when the user is actively speaking) and (e.g. occasional) ambient noise, in order to increase the sound quality, i.e. removing or minimising the ambient noise and obtaining the speech signal part (when present) as clearly as possible or as preferred for a given application. Noise suppression may both be applied when the user is speaking and when the user is not speaking.

Certain noise suppression methods e.g. involve the use of two or more receiving microphones or sound/acoustic transducers, sensors, transceivers, receivers, etc. (all simply referred to as a receiver in the following) and various schemes or algorithms to supress or remove noise.

In such schemes, certain known techniques normally require or assume that the noise is substantially similar at both receivers while the speech signal is more or less (but optimally only) present at one of the receivers.

Practically, this may e.g. be achieved by having a transmission difference between the two receivers for a speech signal and noise.

Achieving a transmission difference is normally done by having a relatively large physical distance between the two receivers as this provides different attenuation of and/or a time delay between the two signals (both signals including speech (when present) and noise (when present)) obtained at each receiver.

However, a drawback of such schemes is that the transmission difference of noise received by the two receivers in reality will not be identical and/or that the speech signals received by the two receivers in reality will be too similar to the transmission difference (between the receivers) of the noises, which may result in degraded noise suppression performance.

Noise suppression is of general interest in many audio-related applications including so-called normal use by regular users, e.g. using a headset for your phone or communications device, in traditional every-day noise environments.

In addition, noise suppression in comparatively severe noise environments presents its own challenges.

One use scenario is e.g. audio communication during transport of armed forces and/or during missions. As an example, the noise inside a helicopter or an armoured vehicle may be as much as 130 dB sound pressure level (SPL).

Another use scenario is e.g. audio communication in other (very) noisy and sometimes hazardous environments, e.g. as encountered by firefighters, emergency workers, police, and/or the like, where clear sound transmission and reception may even be crucial.

Certain noise suppression methods and systems also involve the use of one or more vibration pickups or transducers, e.g. such as one or more bone conduction microphones (BCMs) or corresponding. In such methods and systems, it is typically assumed and relied upon that the BCM, vibration pickup or transducer, etc. is perfectly shielded and therefore assumed practically speaking not being sensitive to ambient noise to any extent. However, contrarily that may not always or even often be the case which leads to noise contributions for a speech signal that are not addressed appropriately or even at all by many noise suppression methods and systems.

Patent specification US 2011/0135106 discloses a system for reducing ambient noise for mobile devices, such as a mobile phone, by using—in one embodiment—a combination of signals from an "in ear" speaker, a standard microphone, and a bone conduction microphone. According to this specification, the bone conduction microphone is assumed to be ideal in the sense that it is not sensitive to ambient noise to any extent and its signal is used accordingly. However, contrarily a bone conduction microphone may very well pick up or at least be influenced by airborne signals such as airborne speech and airborne noise causing vibrations to the bone conduction microphone interfering with or at least influencing registration or pick-up of "bone-conducting" vibrations propagating through the user. Not taking the presence of such airborne signal(s) into account may degrade the quality of the used ambient noise reduction scheme, especially in very noisy environments. The noise reduction scheme according to patent specification US 2011/0135106 uses adaptive filters and avoids adaptation during silence of the user and, at least in some embodiments, require calibration in a quiet environment.

Patent specification US 2014/0029762 relates to noise reduction in connection with a head-mounted sound capture device, e.g. glasses, comprising an air microphone and a vibration sensor where an equalizing transfer function between clear voice signals of the air microphone and the vibration sensor is e.g. determined during training or calibration with the user speaking in quiet environments where the ambient sound level is below a certain level for a certain period of time using the air microphone only.

OBJECT AND SUMMARY OF THE INVENTION

It is an object to provide a system and corresponding method that provides noise suppression of a sound signal.

Additionally, an objective is to provide a system and corresponding method that enables noise suppression of a sound signal in normal but also even for medium to very noisy environments.

Another objective is to provide reliable noise suppression when using a number of sound receivers wherein at least one of the sound receivers is a vibration pickup or transducer, e.g. such as a bone conduction microphone (BCM) or corresponding that may be influenced by airborne signals.

Yet another objective is to provide suppression of ambient noise for a sound receiver being a vibration pickup or transducer, BCM, or corresponding.

According to one aspect, one or more of these objects is/are achieved at least to an extent by a noise suppression system for noise suppression of a sound signal, the sound signal comprising speech of a user when the user is speaking, the system comprising at least one first sound receiver adapted to obtain, during use, a first sound signal, and at least one second sound receiver adapted to obtain, during use, a second sound signal, wherein the first sound signal comprises a first airborne noise signal when noise is present and a first airborne speech signal when the user is speaking, the second sound signal comprises a second airborne noise signal when noise is present and a second airborne speech signal when the user is speaking, the at least one first sound receiver is a vibration pickup or transducer adapted to obtain, during use, an additional speech signal when the user is speaking, wherein the additional speech signal is obtained directly or indirectly in response to vibrations propagating through the user, the vibrations being caused by the user speaking, and the first sound signal further comprises the additional speech signal when the user is speaking, wherein the system is adapted to suppress, during use, at least a part of the first airborne noise signal, when present, in the first sound signal.

In this way, ambient noise is effectively suppressed or removed from the signal received by the vibration pickup or transducer, such as a BCM or the like, even if such sound receivers typically are practically considered as being insensitive to ambient noise. Removing the ambient noise in such a manner increases the quality of speech also for relatively loud noise environments.

By using a vibration pickup or transducer (e.g. a bone conduction microphone (BCM)), another signal path (mainly for speech) to only one of the receivers (i.e. the vibration pickup or transducer) is provided (directly or indirectly as mentioned below) making it possible to place the two receivers with a relatively small physical distance between them while still having different transmission paths to the receivers for speech and keeping more or less the same transmission paths for the noise. This enables a setup being more ideal for noise suppression algorithms.

Furthermore, the speed of sound through bone, tissue, etc. is much higher than through air, which leads to a time difference between the speech received at the vibration pickup or transducer and the (same) speech received via airborne speech signal(s) making the vibration pickup or transducer signal path more unique. This further enables improved performance and easier control of an applied noise suppression algorithm.

By obtaining the additional speech signal directly is to be understood that the vibration pickup or transducer is in direct contact with the user when obtaining the vibrations. By obtaining the additional speech signal indirectly is to be understood that the vibration pickup or transducer is not in direct contact with the user when obtaining the vibrations and thereby then obtains airborne vibrations (e.g. in the ear canal, behind an ear, and/or in another shielded or partly shielded cavity or semi-cavity of the user) where the airborne vibrations are caused by the vibrations propagating through the user. Obtaining the additional speech signal both directly and indirectly is different to obtaining a sound signal (comprising noise and/or speech) that has propagated only in air.

It is to be understood that the noise suppression in the sound signal may be performed—depending on the specific embodiment(s)—regardless of whether the sound signal at a specific moment comprises speech of a user or not.

One option is e.g. to apply the noise suppression ongoingly for a given period of time. This may e.g. be beneficial in full duplex systems, e.g. like in telephones and intercom systems, where a sound channel is permanently (i.e. at least during use) active.

Another option is e.g. to only apply the noise suppression when it is detected that a user is speaking, about to speak, and/or expected to speak. This may e.g. be beneficial in intermittent systems, e.g. in push-to-talk (PTT) systems and/or other half duplex communication systems (or even in full duplex systems) to conserve energy. Which option to use may depend on an actually present or expected noise level.

In some embodiments, the system is adapted to suppress at least a part of the first airborne noise signal using a derived or determined relationship (such as a function) between the first sound signal and the second sound signal. This provides a reliable and robust way of suppressing the first airborne noise signal as disclosed herein.

In some embodiments, the system further comprises a filter adapted to suppress the at least a part of the first airborne noise signal.

In some embodiments, the filter is an adaptive filter using the first sound signal and the second sound signal. In this way, noise may be suppressed taking actual current conditions into account.

In some embodiments, the derived or determined relationship is a derived or determined linear relationship.

In some alternative embodiments, the derived or determined relationship is a derived or determined non-linear relationship.

In some embodiments, the derived or determined relationship is a transfer function (e.g. as disclosed herein) or an impulse response.

In general, any suitable relationship may be used as long as the relationship is of a type that enables making the first sound signal and the second sound signal, or alternatively for some embodiments the first airborne noise signal and the second airborne noise signal, substantially similar at least some of the time.

In some embodiments, the filter is adapted to filter the second sound signal using the derived or determined relationship between the first sound signal and the second sound signal resulting in a filtered signal, wherein the system is further adapted to remove or subtract the filtered signal from the first sound signal. This results in a first sound signal where noise greatly and efficiently is reduced or cancelled by suppressing the airborne signal(s) (e.g. the first airborne noise signal and/or the first airborne speech signal) received by the first receiver.

In some alternative embodiments, the filter is adapted to filter the first sound signal using the derived or determined relationship between the first sound signal and the second sound signal resulting in a filtered signal, wherein the system is further adapted to remove or subtract the filtered signal from the second sound signal.

In some embodiments, the system is adapted to dynamically determine or derive the derived or determined relationship between the first sound signal and the second sound signal when or as long as the user is determined to not be speaking. When the user is not speaking, the first sound signal will basically only be the first airborne noise signal and the second sound signal will basically only be the second airborne noise signal, which enables deriving or determining a relationship that is very suitable for noise suppression in a simpler way e.g. as disclosed herein, e.g. in connection with FIG. 2.

In some further embodiments, the derived or determined relationship is locked (i.e. not updated) when the user is speaking. This is an advantage as it avoids dynamically determining or deriving the relationship (i.e. adaptation) between the first sound signal and the second sound signal when the respective signals now are more complex due to then also containing speech signals parts or components that make the determination of the relationship more complex.

So when the user is speaking, the given derived or determined relationship will be locked in place until the user stops speaking whereby it will be updated dynamically again to reflect a potentially changing noise environment.

In situations where the noise does not drastically change character for a period of time between the user not speaking (adaptation) and the user speaking (no adaptation) this is fully adequate.

In some embodiments, a rate of dynamically deriving or determining the relationship (i.e. rate of adaptation) is dependent on one or more selected from the group consisting of: an amount of available power, a level of the noise being above a predetermined threshold signifying a high level of noise, that the system is plugged in for power, a degree of likelihood of whether speech is present, and that a battery of the system is charged above a given threshold. A higher rate will generally improve the quality of the sound due to 'finer' tuned noise suppression but also consume more power. Therefore, there is a benefit in adjusting the rate according to a level of readily available (or remaining) power. There is also an advantage in adjusting the rate in relation to the amount of noise and thereby only use more or additional power when there is a need or bigger need.

In some embodiments, e.g. in situations when there is uncertainty for a given reason about whether the user is actually speaking or not, adaptation may be continued and then potentially also during when the user is speaking with no severe drawbacks. Alternatively or additionally, the rate of dynamically determining the relationship/of adaptation may be diminished when there is uncertainty about whether the user is speaking or not.

In some embodiments, the system further comprises a voice activity detector adapted to determine whether a user is speaking or not based on the additional voice signal. This enables for very reliable voice detection since the additional voice signal, due to propagating at least partly but e.g. fully through bone, tissue, etc. is less prone to interference and also travels faster than in air.

In some embodiments, the filter is a static filter, where the static filter has a filter profile that has been determined previously and is stored accessibly by the system.

In some embodiments, the system has stored and/or has access to one or more pre-determined filter profiles for the filter and wherein a given filter profile is selected and used from among the one or more pre-determined profiles depending on an automatic selection made in dependence on one or more of: a current registered sound level, noise type, a specific type of connected and/or used piece of equipment (e.g. a specific type of headset, push to talk unit, etc.), whether a given connected and/or used piece of equipment has been turned off, whether a given user-worn connected and/or used piece of equipment has been removed, an available amount of power, and/or a user selection.

In some embodiments, a derived or determined relationship between the first airborne noise signal and the second airborne noise signal is used instead of the derived or determined relationship between the first sound signal and the second sound signal. In some embodiments, this is readily achieved by performing adaptation/dynamic update when the user is not speaking as disclosed herein.

In some embodiments, the system is further adapted to suppress, during use, at least a part of the second airborne speech signal in addition to suppressing at least a part of the first airborne noise signal.

In some embodiments, the system is adapted to suppress at least a part of the first airborne noise signal, when present, in the first sound signal only when it is determined that the user is speaking, about to speak, and/or expected to speak. In this way, power may be saved as the noise suppression is then only applied some of the time. An appropriate voice activity detector or the like, e.g. as disclosed herein, may e.g. be used to determine whether a user is speaking or not.

In some embodiments, at least one of the at least first receiver(s) is

- a bone conduction microphone,
- a receiver encapsulated in a closed enclosure, the enclosure further comprising air,
- a throat microphone or a head-mounted microphone, the head-mounted microphone being adapted, during use, to register sound propagating through a user's skull,
- a sound receiver located at or in a shielded or partly shielded cavity or semi-cavity (e.g. in the ear canal, behind an ear, etc.) of the user,
- a sound receiver or microphone located in an ear canal of the user, e.g. shielded from outside sound, and/or
- an accelerometer.

In some embodiments, the second receiver is also a vibration pickup or transducer or a bone conduction microphone adapted to obtain vibrations propagating through the user, the vibrations being caused by the user speaking, by contact to the user or adapted to obtain airborne vibrations where the airborne vibrations are caused by vibrations propagating through the user, the vibrations being caused by the user speaking.

In some embodiments,

- the at least one first sound receiver is adapted to register vibrations via contact to the user and the at least one second sound receiver is a vibration pickup or transducer adapted to obtain airborne vibrations where the airborne vibrations are caused by vibrations propagating through the user, the vibrations being caused by the user speaking.

In some embodiments, the system comprises

- a first sub-system comprising one of the at least one first sound receivers and one of the at least one second sound receivers, and
- a second sub-system comprising one of the at least one first sound receivers and one of the at least one second sound receivers.

The first sub-system may e.g. be associated with or located on a left side of the user while the second sub-system is associated with or located on a right side of the user.

Having two parallel sub-systems provides more signals and may be used or combined to increase the quality of noise suppression even further.

A further aspect relates to a method of noise suppressing a sound signal and embodiments thereof corresponding to the system and embodiments thereof and having corresponding advantages.

More particularly, the further aspect relates to a method of noise suppressing a sound signal, the sound signal comprising speech of a user when the user is speaking, the method comprising the steps of:

- obtaining a first sound signal by at least one first sound receiver wherein the at least one first sound receiver is a vibration pickup or transducer, and obtaining a second sound signal by at least one second sound receiver, wherein the first sound signal comprises a first airborne noise signal when noise is present and a first airborne speech signal when the user is speaking, and the second sound signal comprises a second airborne noise signal when noise is present and a second airborne speech signal when the user is speaking, and wherein the method further comprises the steps of:

obtaining an additional speech signal when the user is speaking by the at least one first sound receiver, wherein the additional speech signal is obtained directly or indirectly in response to vibrations propagating through the user, the vibrations being caused by the user speaking and the first sound signal further comprises the additional speech signal when the user is speaking, and suppressing at least a part of the first airborne noise signal, when present, in the first sound signal.

In some embodiments, the step of suppressing at least a part of the first airborne noise signal comprises using a derived relationship between the first sound signal and the second sound signal.

In some embodiments, the step of suppressing at least a part of the first airborne noise signal uses a filter to suppress the at least a part of the first airborne noise signal.

In some embodiments, the filter is an adaptive filter using the first sound signal and the second sound signal.

In some embodiments, the derived relationship is a linear relationship.

In some embodiments, the derived relationship is a non-linear relationship.

In some embodiments, the derived relationship is a transfer function, an impulse response, or any corresponding or equivalent function.

In some embodiments, the filter filters the second sound signal using the derived relationship between the first sound signal and the second sound signal resulting in a filtered signal, and the method further comprises removing or subtracting the filtered signal from the first sound signal.

In some embodiments, the filter filters the first sound signal using the derived relationship between the first sound signal and the second sound signal resulting in a filtered signal, and the method further comprises removing or subtracting the filtered signal from the second sound signal.

In some embodiments, the method dynamically derives the derived relationship between the first sound signal and the second sound signal when the user is determined to not be speaking.

In some embodiments, the method locks the derived relationship when the user is speaking.

In some embodiments, a rate of dynamically deriving the derived relationship is dependent on one or more selected from the group consisting of: an amount of available power, a level of the noise being above a predetermined threshold signifying a high level of noise, that a system using the method is plugged in for power, a degree of likelihood of whether speech is present, and that a battery of the system using the method is charged above a given threshold.

In some embodiments, the method comprises determining, by a voice activity detector, whether a user is speaking or not based on the additional voice signal.

In some embodiments, the filter is a static filter, where the static filter has a filter profile that has been determined previously and is stored accessibly to the method.

In some embodiments, the method has access to one or more pre-determined filter profiles for the filter and wherein a given filter profile is selected and used from among the one or more pre-determined profiles depending on an automatic selection made in dependence on one or more of: a current registered sound level, noise type, a specific type of connected and/or used piece of equipment, e.g. a specific type of headset, push to talk unit, etc., whether a given connected and/or used piece of equipment has been turned off, whether a given user-worn connected and/or used piece of equipment has been removed, an available amount of power, and/or a user selection.

In some embodiments, a derived relationship between the first airborne noise signal and the second airborne noise signal is used instead of the derived relationship between the first sound signal and the second sound signal.

In some embodiments, the method further comprises suppressing, during use, at least a part of the second airborne speech signal in addition to suppressing at least a part of the first airborne noise signal.

In some embodiments, the method further suppresses at least a part of the first airborne noise signal, when present, in the first sound signal only when it is determined that the user is speaking, about to speak, and/or expected to speak.

In some embodiments, at least one of the at least first receiver is a bone conduction microphone, a receiver encapsulated in a closed enclosure, the enclosure further comprising air, a throat microphone or a head-mounted microphone, the head-mounted microphone being adapted, during use, to register sound propagating through a user's skull, a sound receiver located at or in a shielded or partly shielded cavity or semi-cavity (e.g. in the ear canal, behind an ear, etc.) of the user, a sound receiver or microphone located in an ear canal of the user, e.g. shielded from outside sound, and/or an accelerometer.

In some embodiments, the second receiver is a vibration pickup or transducer or a bone conduction microphone and the method comprises obtaining vibrations, by the second receiver propagating through the user, the vibrations being caused by the user speaking, by contact to the user or adapted to obtain airborne vibrations where the airborne vibrations are caused by vibrations propagating through the user, the vibrations being caused by the user speaking.

In some embodiments, the at least one first sound receiver is adapted to register vibrations via contact to the user and the at least one second sound receiver is a vibration pickup or transducer adapted to obtain airborne vibrations where the airborne vibrations are caused by vibrations propagating through the user, the vibrations being caused by the user speaking.

The method and embodiments thereof correspond to the system and embodiments thereof and have the same advantages for the same reasons.

BRIEF DESCRIPTION OF THE DRAWINGS

These and other aspects will be apparent from and elucidated with reference to the illustrative embodiments as shown in the drawings, in which.

DESCRIPTION OF PREFERRED EMBODIMENTS

Figure 1:
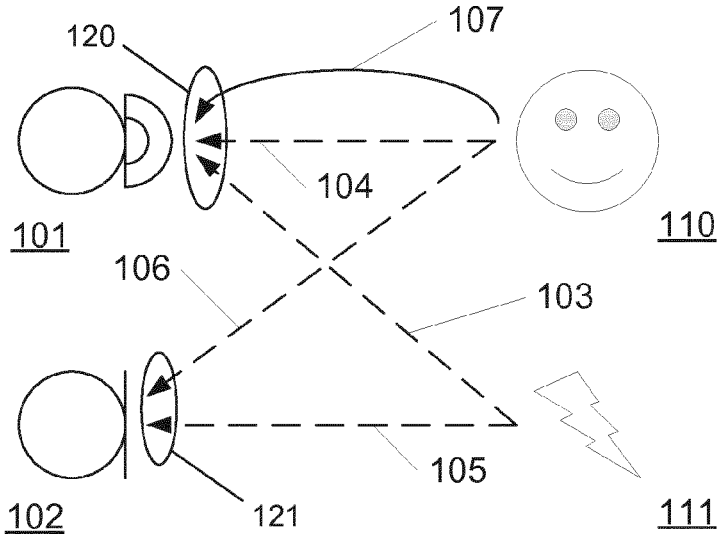
FIG. 1 illustrates a schematic representation of noise and speech signals, a user, and two receivers.

FIG. 1 illustrates a schematic representation of noise and speech signals, a user, and two receivers.

Shown is a schematic representation of a user 110 and noise 111 from one or more ambient noise sources.

Further shown is a first sound receiver 101 and a second sound receiver 102 and multiple arrows illustrating what sound signals or sound signal components the receivers 101, 102 generally will receive during use and when the user actively speaks and/or noise is present. The receivers 101, 102 may be physically located in a suitable system or device during use according to various different embodiments e.g. as described elsewhere in this description or at least be connected to such system or device or similar. The four dashed arrows 103, 104, 105, and 106 represent sound signals that propagate through ambient air as a propagation medium.

The first receiver 101 will generally receive a first airborne noise signal 103, as represented by a dashed arrow from 111 to 101, from one or more ambient noise sources when noise 111 is present and receive a first airborne speech signal 104, as represented by a dashed arrow from 110 to 101, when the user 110 is speaking.

The second receiver 102 will generally receive a second airborne noise signal 105, as represented by a dashed arrow from 111 to 102, from the one or more ambient noise sources when noise 111 is present, and receive a second airborne speech signal 106, as represented by a dashed arrow from 110 to 102, when the user 110 is speaking.

It is to be understood that a given receiver will register a single signal being a combination in some form of the various signals, i.e. a combination of speech (when the user is speaking) and noise signals (when noise is present). This is schematically illustrated in FIG. 1 by reference numbers 120 and 121. So the first sound receiver 101 will obtain a first sound signal 120 comprising the first airborne noise signal 103 and the first airborne speech signal 104 (when they respectively are present) while the second sound receiver 102 will obtain a second sound signal 121 comprising the second airborne noise signal 105 and the second airborne speech signal 106 (when they respectively are present).

When the first receiver 101 is a so-called vibration pickup or transducer (as is the case in these exemplary embodiments) or similar, the first receiver 101 will also receive an additional speech signal 107, as represented by a non-broken arrow from 110 to 101, when the user 110 speaks. I.e. the first sound signal 120 will further comprises the additional speech signal 107 when the user 110 is speaking.

Vibration pickups or transducers are also often referred to as bone-conduction microphones (or BCM for short), pickups, transducers, etc. Other devices being able to pick up or register sound based on vibrations propagating through another medium than ambient air may also be usable within this context.

The additional speech signal 107 may be obtained either directly or indirectly in response to vibrations propagating through the user where the vibrations are caused by the user speaking. By obtaining the additional speech signal directly is to be understood that the vibration pickup or transducer is in direct contact with the user when obtaining the vibrations. By obtaining the additional speech signal indirectly is to be understood that the vibration pickup or transducer is not in direct contact with the user when obtaining the vibrations and thereby obtains airborne vibrations (e.g. in the ear canal, etc.) where the airborne vibrations then are caused by the vibrations propagating through the user. According to some aspects, a regular microphone or receiver may also be regarded as a BCM that—indirectly—will obtain vibrations having propagated through the user.

The vibration pickup or BCM may e.g. be of the type that during use is located in a user's ear canal and picks up vibrations from there either directly or indirectly. Such devices are generally known. Alternatively, the vibration pickup may e.g. be a throat mic, a head-mounted microphone being able to register sound propagating through a user's skull, etc. All such applicable devices will simply be referred to as a BCM or BCMs throughout this specification.

The additional speech signal 107 is therefore propagating through another medium than air at least some of the way, which makes the signal different (in time and/or level) from the first airborne speech signal 104 even though they register speech from the same user. This is the case for both the direct and indirect way of obtaining the additional speech signal due to the signal propagating in both cases through another medium than air (even though that in the indirect way, it also propagates some of the way in air).

The BCM may as an example be located during use in the user's ear canal and will in such a situation register speech using vibrations (primarily) caused by the sound produced by the user speaking and propagating through the tissue, bones, etc. of the user to the BCM or to the BCM via an air gap.

In principal, the BCM 101 may also receive a noise signal (not shown) propagating through the tissue, bones, etc. of the user. However, that signal is for all practical purposes, unless expressively stated otherwise, negligible in this context.

The second sound receiver 102 is more or less a traditional sound receiver, adapted to receive sound propagating through air. Such receivers may e.g. often be referred to as a spy microphone, hear-through microphone, or the like.

Such a setup and different embodiments thereof allows for improved noise suppression as will be explained in the following and throughout this specification.

By using a BCM 101, another signal path (mainly for speech) to only one of the receivers (i.e. the BCM) is provided (directly or indirectly as mentioned above) making it possible to place the two receivers with a relatively small physical distance between them while still having different transmission paths to the receivers for speech and keeping more or less the same transmission paths for the noise. This enables a setup being more ideal for noise suppression algorithms.

Furthermore, the speed of sound through bone, tissue, etc. is much higher than air, which leads to a time difference between the speech received at the BCM and the (same) speech received via airborne speech signal(s) making the BCM signal path more unique. This further enables improved performance and easier control of an applied noise suppression algorithm.

Figure 3:
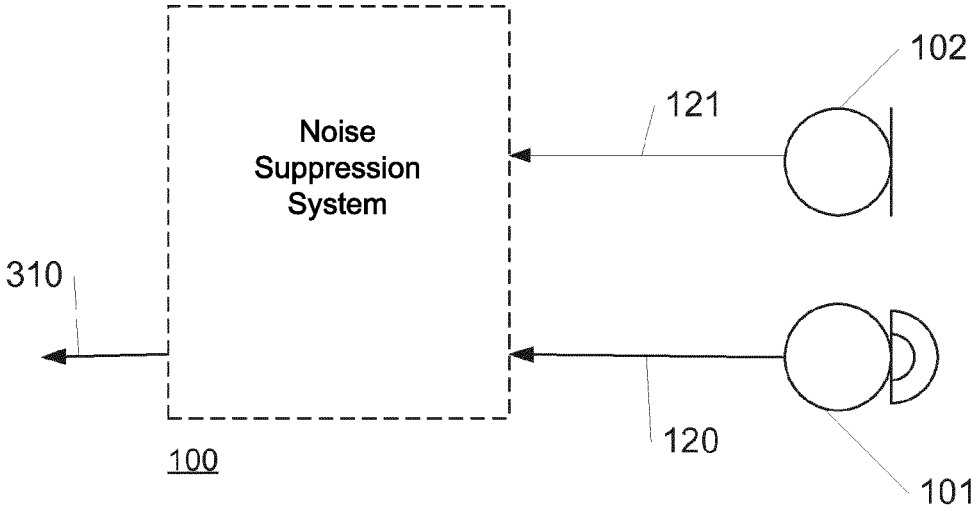
FIG. 3 schematically illustrates one exemplary embodiment of a system for noise suppression.
Figure 2:
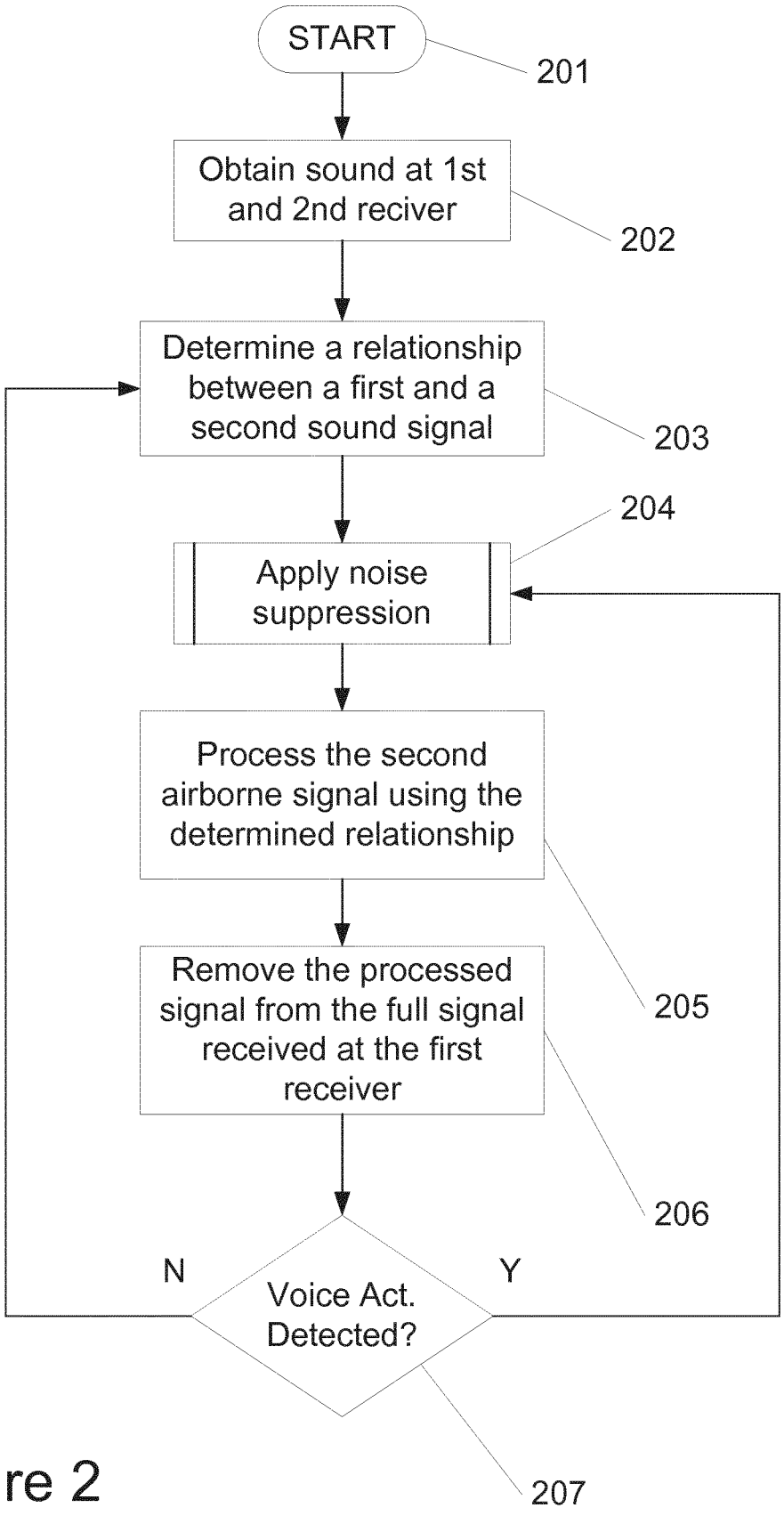
FIG. 2 schematically illustrates one exemplary embodiment of a method of noise suppression.
Figure 4:
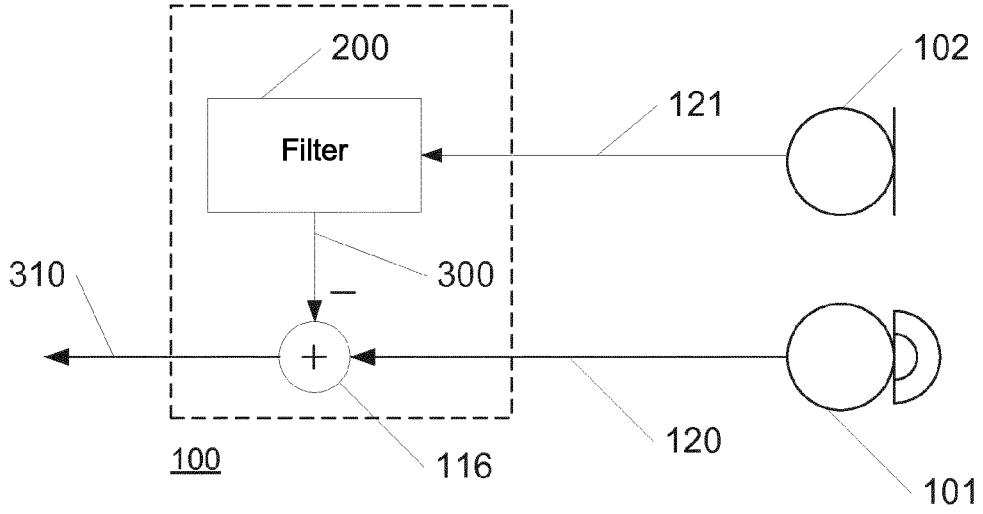
FIG. 4 schematically illustrates an exemplary more specific embodiment of a system for noise suppression.

Exemplary embodiments of advantageous noise suppression algorithms to use with such a setup and variations thereof are e.g. explained further in connection with FIGS. 2-4.

As explained elsewhere, it is also possible to use more than two receivers to increase the quality of the noise suppression even further in some situations. In general, a noise suppression system may comprise one or more first receivers and one or more second receivers.

As an alternative, the second receiver(s) 102 may also be a vibration pickup or transducer e.g. a BCM (so there are two or more).

The receivers and the noise suppression system may be implemented in a head-set, telephone, (intelligent or 'smart') glasses, (gas)masks with a contact point to the head, all other applicable headwear, a hearing protection device, or the like. In some embodiments, the first and second receiver may, during use, be located separately with one receiver in each ear of the user.

FIG. 2 schematically illustrates one exemplary embodiment of a method of noise suppression.

The method generally starts or initiates at step 201 and proceeds to step 202 where sound will be obtained by (at least) a first and (at least) a second sound receiver. The first and second sound receiver may (and preferably do) correspond to the first and the second sound receiver 101 and 102 e.g. as shown and explained in connection with FIGS. 1, 3, and 4.

As described in connection with FIG. 1, the first sound receiver will obtain a first sound signal (not shown; see e.g. 120 in FIG. 1) comprising a first airborne noise signal (see e.g. 103 in FIG. 1) and a first airborne speech signal (see e.g. 104 in FIG. 1) (when they respectively are present) while the second sound receiver will obtain a second sound signal (not shown; see e.g. 121 in FIG. 1) comprising a second airborne noise signal (see e.g. 105 in FIG. 1) and a second airborne speech signal (see e.g. 106 in FIG. 1) (when they respectively are present).

In addition, the first sound signal obtained by the first receiver will also comprise an additional speech signal (not shown; see e.g. 107 in FIG. 1) propagating through a different medium than air (at least during some part of its transmission path) when a user is speaking since the first receiver is a vibration pickup or transducer e.g. in the form of a BCM or the like as explained previously.

Practically speaking, the sound will be obtained at least in some embodiments by the first and the second receiver continuously or ongoingly (at least during use).

At step 203, a given predetermined relationship between the first sound signal, received by the first receiver, and the second sound signal, received by the second receiver, is determined when the user is not speaking.

The specific relationship to determine may typically depend on the specific embodiment and/or use.

In some embodiments, the relationship to determine is a linear relationship. Alternatively, the relationship to determine may be a non-linear relationship.

In some further embodiments, the relationship to be determined is a transfer function between the first sound signal, received by the first receiver, and the second sound signal, received by the second receiver, when the user is not speaking. The relationship or transfer function may e.g. be determined initially or anew (i.e. updated adaptively) as will be explained in the following.

Letting the first sound signal (see e.g. 120 in FIG. 1) and the second sound signal (see e.g. 121 in FIG. 1) be designated as BCM and MIC, respectively, then the first (BCM) and the second (MIC) sound signal may be represented as:

$$\text{BCM(120)}: D[z]=A_{BCM}[z]S[z]+B_{BCM}[z]S[z]+\Gamma_{BCM}[z]L[z]$$

$$\text{MIC(121)}: X[z]=B_{MIC}[z]S[z]+\Gamma_{MIC}[z]L[z]$$

where S[z] is an airborne speech signal from a user (see e.g. 110 in FIG. 1), L[z] is an airborne noise signal from one or more noise sources (see e.g. 111 in FIG. 1), B[z] defines a respective transfer function of an airborne speech signal to the BCM and to the MIC, respectively, Γ[z] defines a respective transfer function of an airborne noise signal to the BCM (103) and to the MIC (105), respectively, and A[z] defines a transfer function of a speech signal to the BCM though the bone, tissue, etc. of the user.

In the notation of FIG. 1 and elsewhere, $A_{BCM}[z]S[z]$ corresponds to the additional speech signal 107 in the frequency domain, $B_{BCM}[z]S[z]$ corresponds to the first airborne speech signal 104 in the frequency domain, $\Gamma_{BCM}[z]L[z]$ corresponds to the first airborne noise signal 103 in the frequency domain, $B_{MIC}[z]S[z]$ corresponds to the second airborne speech signal 106 in the frequency domain, and $\Gamma_{MIC}[z]L[z]$ corresponds to the second airborne noise signal 105 in the frequency domain.

When the determination is done during an absence of the user speaking then the first sound signal will basically only be the first airborne noise signal and the second sound signal will basically only be the second airborne noise signal since the speech signals (e.g. 104, 106, and 107) quite simply are not present in the first and second sound signals when the user is not speaking.

A voice activity detector or the like may e.g. be used to determine whether a user is speaking or not e.g. as explained further below.

Therefore, it will practically be the given relationship (e.g. the transfer function, impulse response, etc.) between the first airborne and the second airborne noise signals that is determined when the user is not speaking.

The first and the second airborne noise signals will basically be similar and will be received basically at the same time at both receivers. When the user is speaking, both receivers will also receive basically the same airborne speech signal at basically the same time.

This is especially the case, if the two receivers are located in relative close proximity to each other, which is different from many other noise suppression setups that require that the receivers are distanced relatively far from each other (normally at least a couple of centimetres apart but sometimes even up to as much as 10 centimetres apart) to allow for a sufficient time difference between the received signals. On the contrary, the present invention functions very well even with the two or more receivers being located practically on top of or next to each other.

Assuming no current speech (S[z]=0), the difference in noise transfer functions to the two received signals (120, 121) H[z] can be estimated by the transfer function $\hat{H}[z]$ $$\text{BCM(120)}: D[z]=\Gamma_{BCM}[z]L[z]$$

$$\text{MIC(121)}: X[z]=\Gamma_{MIC}[z]L[z]$$

$$\hat{H}[z]=D[z]X^{-1}[z]=\Gamma_{BCM}[z]\Gamma_{MIC}^{-1}[z]$$

Accordingly, in this particular and corresponding embodiments, the transfer function $\hat{H}[z]$ is the determined or derived relationship between the first sound signal, received by the first receiver, and the second sound signal, received by the second receiver, which when determined or derived when the user is not speaking becomes a relationship (and transfer function) between the first airborne noise signal (see e.g. 103 in FIG. 1) and the second airborne noise signal (see e.g. 105 in FIG. 1).

As another example, the relationship to be determined may be an impulse response. Corresponding or equivalent formulas as given above may be formulated for an impulse response as generally known.

In general, any suitable relationship may be used as long as the relationship is of a type that enables making the first sound signal and the second sound signal, or alternatively for some embodiments the first airborne noise signal and the second airborne noise signal, substantially similar.

In some embodiments, the relationship may be determined when speech is not detected (or during pauses between words of a spoken sentence) as described above and elsewhere. In alternative embodiments, the relationship may be determined also when a user is speaking. This may still suppress noise.

At step 204 noise suppression is applied using the relationship determined at step 203, e.g. the transfer function, or other linear or non-linear relationship, as carried out, in this particular and corresponding embodiments, by steps 205 and 206.

In this way, the relationship is determined and used dynamically.

Practically, the reception of sound (step 202) and (when active) the determination of the relationship (step 203) may virtually be done simultaneously and in real-time. However, it could of course also be that the relationship is only determined at certain intervals and/or situations, either predefined or dynamic. As an example, the relationship may e.g. be determined every few milliseconds but it may be highly dependent on a specific application and/or situation. For example, in certain 'special' noise situations, the relationship may e.g. be determined only every second or so. The rate of determination/update may e.g. also be dependent on an amount of available power. The determination/update rate may e.g. be increased in situations with a high level of noise, a unit is plugged in for power, a degree of likelihood of whether speech is present, a unit's battery is charged above a given threshold, and/or in general as necessary.

When noise suppression is applied, the determined relationship is used to suppress noise. As one example, a determined transfer function may be used by an appropriate filter or the like to suppress noise as explained further in the following.

In some embodiments, the second sound signal, i.e. the sound signal registered by the second receiver, is processed or filtered (continuously or ongoingly or at least as long as noise suppression is applied) using the determined relationship resulting in a processed or filtered signal being similar to the signal received by the first receiver. In particular, if the determined relationship is a transfer function, the second sound signal is processed or filtered using the determined transfer function resulting in the processed or filtered signal. This is carried out at step 205.

Continuing the exemplary embodiment above, the estimated difference in noise transfer, i.e. $\hat{H}[z]$, may then, at step 205, be applied to the received second (MIC) sound signal to estimate the noise signal as received by the first sound receiver (i.e. to estimate the noise signal part of the received first (BCM) sound signal)

$$\hat{D}[z]=X[z]\hat{H}[z]$$

where $\hat{D}[z]$ is the processed or filtered signal.

At step 206, this processed or filtered signal is then continuously or ongoingly (again as long as noise suppression is applied) removed or subtracted from the first sound signal, i.e. the sound signal registered by the first receiver.

Continuing the exemplary embodiment above, the processed or filtered signal $\hat{D}[z]$ may then, at step 206, be subtracted from the first (BCM) sound signal yielding $$\text{BCM(120)}:D[z]=A_{BCM}[z]S[z]+B_{BCM}[z]S[z]+\Gamma_{BCM}[z]L[z]-\hat{D}[z]\Rightarrow$$

$$\text{BCM(120)}:D[z]\approx A_{BCM}[z]S[z]+B_{BCM}[z]S[z]$$

as $\hat{D}[z]$ will suppress or remove the first airborne noise signal in the frequency domain $\Gamma B_{BCM}[z]L[z]$.

In this way, noise is effectively suppressed or ideally removed from the received first (BCM) sound signal leaving speech with little or ideally no noise to present in the received first (BCM) sound signal.

Accordingly, this results in a first sound signal where noise is greatly and efficiently reduced or cancelled by suppressing the airborne signals (e.g. 103 and 104 in FIG. 1) received by the first receiver (101 in FIG. 1). When the user is speaking this basically leaves only the additional speech signal to be part of the first sound signal and noise will be suppressed, even in high noise environments. Noise will also be suppressed even when the user is not speaking.

As mentioned, a filter or the like may, as alternatives, not necessarily rely on determining a transfer function. Such a filter assumes a linear relationship between the signals that the transfer function is determined for. Other filters than mentioned above could be used e.g. using other statistical models, blind source separation, non-linear filter models, beam-forming, non-adaptive or static models, etc.

More specifically, some embodiments may use a static or non-adaptive filter where the static filter has a filter profile that has been determined previously, i.e. it is pre-made, suitable for most or certain situations. This is not as versatile or optimal as an adaptive filter but it may still have its advantageous uses. The filter profile is then stored in the noise suppression system ready for use or is at least stored somewhere where it is accessible by the noise suppression system.

In other embodiments, a plurality of pre-made filter profiles is available and one of these is selected and used. The selection may e.g. be done by a user and/or may be done automatically by the system e.g. taking a given current situation into account, e.g. like a given registered sound level, type of present noise, etc.

In cases of a given device, e.g. like a headset or the like, a specific filter selection may be made if the device has been removed from the user (in cases of a user-worn device) and/or has been turned off (potentially for all devices). As an example, there may be filter profiles for low, medium, and high noise levels and a filter profile would be selected for an appropriate situation. As another example, a processing intensive filter (for best quality) may be chosen if a given type of device (e.g. a PTT unit) is connected or used while another less processing intensive filter (perhaps for adequate or medium quality) is chosen when the given type of device is not connected or used.

Other examples could e.g. involve (in addition or instead) different pre-made profiles suitable for other different situations. E.g. a profile for being in an armoured vehicle, another for being in a helicopter, etc., or e.g. a profile for being in a hazardous firefighting environment, etc. Yet another example could e.g. be a profile for a given type of connected headset (e.g. connected to a push-to-talk device implementing the invention) with another profile for another given connected headset, and so on. Or of course combinations thereof.

After step 206 is carried out, a test is made whether voice activity is detected or not (it is noted that the voice activity may include certain natural pauses between uttered words). If not, the method loops back to step 203 where the relationship or transfer function is determined again, i.e. is updated. If yes, the method loops back to step 204 where a next portion or part of the second airborne signal is filtered again whereby the relationship or transfer function then is not updated. So when the user is speaking the given relationship or transfer function will, in this and corresponding embodiments, be locked in place until the user stops speaking whereby it will be updated dynamically again e.g. to reflect and/or accommodate a potentially changing noise environment.

The test at step 207—whether voice activity is detected or not—may in certain embodiments be made based on a voice activity detector or the like (forth only referred to as voice activity detector).

A suitable voice activity detector may fairly easily and efficiently be provided since the first receiver is a vibration pickup or transducer, e.g. a BCM, which already is fairly (but not completely) 'immune' to noise in itself and therefore will receive the already noise reduced additional speech signal propagating (at least partly) through the user when the user is speaking. The presence of the additional and "clean" BCM speech signal will significantly change the received first sound signal thereby enabling reliable and easy detection of when the user is speaking. Much more so than using the first airborne speech signal part in the received first sound signal. Additionally, the additional speech signal will be received by the first receiver much faster than the airborne speech signal due to the faster propagation speed through tissue, bone, etc.

This makes the noise suppression method robust and reliable in addition to providing high quality noise suppression.

Alternatively, the voice activity could be based on the airborne signals—but less optimally then—or through other known voice activity detector schemes and/or criteria.

In this way, steps 202 to 207 are basically done continuously or ongoingly when no speech is determined to be present in the received signal whereby the relationship, e.g. the transfer function, dynamically is determined and then used to process or filter the second airborne signal and removing or subtracting the filtered signal from the first sound signal at steps 205 and 206 thereby suppressing noise.

When voice activity is detected, the last determined/used relationship, e.g. the transfer function, etc., is 'locked' or 'frozen' and used to continuously or ongoingly filter the second airborne signal and removing or subtracting the filtered signal from the first sound signal at steps 205 and 206 as long as the user is speaking, i.e. when the user is speaking, the relationship/the transfer function is no longer updated but still used. It is noted, that step 202 is carried out regardless.

FIGS. 3 and 4 shows and explains further details of one way (and variations thereof) of carrying out steps 205 and 206 (see e.g. 200 in FIG. 4).

As an alternative, it could be the first sound signal that is processed/filtered at step 205 using the determined relationship and then removing or subtracting the resulting processed or filtered signal from the full signal received at the second receiver.

As an alternative, the relationship, e.g. the transfer function, etc., may be determined when the user is speaking although that will not be as optimal and/or as simple as being determined when the user is not speaking.

It is noted, that the dynamic adaptation method of FIG. 2 and corresponding methods as disclosed herein does not require calibration.

FIG. 3 schematically illustrates one exemplary embodiment of a system for noise suppression.

Shown is a noise suppression system 100 for noise suppression of a sound signal where the system 100 comprises a first receiver 101 and a second receiver 102 corresponding to the receivers explained in connection with FIGS. 1 and 2.

The noise suppression system 100 receives a first 120 and a second sound signal 121 as received by the first and second receivers 101, 102, respectively, where the first 120 and second 121 sound signals correspond to the ones already explained in connection with FIGS. 1 and 2 and elsewhere. When noise is present and/or the user is speaking, additional signals (not shown; see e.g. 103, 104, 105, 106, and 107) are also present as explained earlier.

The noise suppression system 100 is adapted to harmonise or equalise the first and the second airborne noise signals preferably in situations where the user is not speaking (whereby the first 120 and second 121 sound signals will be equal to the first and second airborne noise signals, respectively) This may e.g. by done by determining a relationship as explained earlier and elsewhere or alternatively in some other suitable manner.

When applying noise suppression (e.g. both when the user is speaking and not), the harmonised or equalised signal is removed from one of the first and the second sound signal 120, 121 resulting in a sound signal with suppressed noise 310.

In some preferred embodiments, the harmonised or equalised signal is removed from the sound receiver being the BCM receiver or similar, e.g. being as in this particular example the first sound receiver 101.

The harmonisation or equalisation may be done/updated when the user is not speaking corresponding to FIG. 2.

In some embodiments, the noise suppression system 100 is adapted to suppress at least a part of the first airborne noise signal (see e.g. 103 in FIG. 1) using a relationship, as described above and elsewhere, between the first sound signal 120 and the second sound signal 121.

FIG. 4 schematically illustrates an exemplary more specific embodiment of a system for noise suppression.

Shown is a noise suppression system 100 for noise suppression of a sound signal where the system 100 comprises a first receiver 101 and a second receiver 102 corresponding to the receivers explained in connection with FIGS. 1 and 2.

The noise suppression system 100 receives a first 120 and a second sound signal 121 as received by the first and second receivers 101, 102, respectively, where the first 120 and second 121 sound signals correspond to the ones already explained in connection with FIGS. 1 and 2 and elsewhere.

The noise suppression system 100 comprises a filter 200 that receives the second 121 sound signal.

The noise suppression system 100 is adapted to suppress noise, during use, in the first sound signal 120 so that the airborne signals (not shown; see e.g. 103 and 104 in FIG. 1) received by the first sound receiver 101 is removed or reduced (when present), which will suppress the noise significantly. In some embodiments, only the airborne noise signal (not shown; see e.g. 103 in FIG. 1) received by the first sound receiver 101 is removed or reduced (when present).

In some embodiments, the filter 200 is an adaptive filter (as explained in the following and e.g. in connection with FIG. 2) while in other embodiments the filter is a static filter (e.g. as explained in connection with FIG. 2) using one or more pre-determined filter profiles.

In some embodiments, the filter is adaptive and uses input derived on the basis of a first airborne noise signal (see e.g. 103 in FIG. 1) and/or a second airborne noise signal (see e.g. 105 in FIG. 1).

In some further embodiments and more particularly, the filter 200 may use a determined transfer function (or alternatively another relationship), e.g. determined as described in connection with FIG. 2, between the first sound signal, received by the first receiver, and the second sound signal, received by the second receiver. As mentioned, the first sound signal will basically only be the first airborne noise signal and the second sound signal will basically only be the second airborne noise signal during an absence of the user speaking.

The filter 200 will filter the second sound signal continuously or ongoingly (or at least as long as noise suppression is applied) using the determined relationship or transfer function resulting in a processed or filtered signal 300.

The processed or filtered signal 300 is then continuously or ongoingly (again as long as noise suppression is applied) subtracted from the first sound signal 120, e.g. by being negated and added using an adding function or circuit 116, resulting in a sound signal with suppressed noise 310.

As shown in the Figure, the filter 200 receives input from the second receiver 102. However, the filter 200 could equally be connected to be on the other branch and receive input from the first receiver and modifying the other elements accordingly.

In the claims, any reference signs placed between parentheses shall not be constructed as limiting the claim. The word "comprising" does not exclude the presence of elements or steps other than those listed in a claim. The word "a" or "an" preceding an element does not exclude the presence of a plurality of such elements.

The mere fact that certain measures are recited in mutually different dependent claims does not indicate that a combination of these measures cannot be used to an advantage.

It will be apparent to a person skilled in the art that the various embodiments of the invention as disclosed and/or elements thereof can be combined without departing from the scope of the invention as defined in the claims.

The invention claimed is:

1. A noise suppression system for noise suppression of a sound signal in a noisy environment, the sound signal comprising speech of a user when the user is speaking, the system comprising:

at least one first sound receiver configured to obtain, during use, a first sound signal; and at least one second sound receiver configured to obtain, during use, a second sound signal, wherein the first sound signal comprises a first airborne ambient noise signal from one or more ambient noise sources when noise is present and a first airborne speech signal when the user is speaking, the second sound signal comprises a second airborne ambient noise signal from the one or more ambient noise sources when noise is present and a second airborne speech signal when the user is speaking, the at least one first sound receiver is a vibration pickup or transducer configured to obtain, during use, an additional speech signal when the user is speaking, wherein the additional speech signal is obtained directly or indirectly in response to vibrations propagating through the user, the vibrations being caused by the user speaking, and the first sound signal further comprises the additional speech signal when the user is speaking, wherein the system is configured to:

dynamically derive a relationship between the first sound signal and the second sound signal when the user is determined to not be speaking, and suppress, during use, at least a part of the first airborne ambient noise signal, when present, in the first sound signal, wherein the at least a part of the first airborne ambient noise signal is suppressed using the derived relationship between the first sound signal and the second sound signal.

2. The system according to claim 1, wherein the system further comprises a filter configured to suppress the at least a part of the first airborne ambient noise signal.

3. The system according to claim 2, wherein the filter is an adaptive filter using the first sound signal and the second sound signal.

4. The system according to claim 2, wherein the filter is adapted to filter the second sound signal using the derived relationship between the first sound signal and the second sound signal resulting in a filtered signal, and wherein the system is further adapted to remove or subtract the filtered signal from the first sound signal.

5. The system according to claim 2, wherein the filter is further configured to:

filter the first sound signal using the derived relationship between the first sound signal and the second sound signal resulting in a filtered signal, and wherein the system is further configured to remove or subtract the filtered signal from the second sound signal.

6. The system according to claim 2, wherein the filter is a static filter, where the static filter has a filter profile that has been determined previously and is stored accessibly by the system.

7. The system according to claim 2, wherein the system has stored or has access to one or more pre-determined filter profiles for the filter and wherein a given filter profile is selected and used from among the one or more pre-determined profiles depending on an automatic selection made in dependence on one or more of: a current registered sound level, noise type, a specific type of connected and/or used piece of equipment, whether a given connected and/or used piece of equipment has been turned off, whether a given user-worn connected or used piece of equipment has been removed, an available amount of power, and/or a user selection.

8. The system according to claim 1, wherein the derived relationship is a linear relationship.

9. The system according to claim 1, wherein the derived relationship is a non-linear relationship.

10. The system according to claim 1, wherein the derived relationship is a transfer function or an impulse response.

11. The system according to claim 1, wherein the derived relationship is locked when the user is speaking.

12. The system according to claim 1, wherein a rate of dynamically deriving the relationship is dependent on one or more selected from the group consisting of: an amount of available power, a level of the noise being above a predetermined threshold signifying a high level of noise, that the system is plugged in for power, a degree of likelihood of whether speech is present, and that a battery of the system is charged above a given threshold.

13. The system according to claim 1, wherein the system further comprises a voice activity detector configured to determine whether a user is speaking or not based on the additional voice signal.

14. The system according to claim 1, wherein a derived relationship between the first airborne ambient noise signal and the second airborne ambient noise signal is used instead of the derived relationship between the first sound signal and the second sound signal.

15. The system according to claim 1, wherein the system is further configured to suppress, during use, at least a part of the second airborne speech signal in addition to suppressing at least a part of the first airborne ambient noise signal.

16. The system according to claim 1, wherein the system is configured to suppress at least a part of the first airborne ambient noise signal, when present, in the first sound signal only when it is determined that the user is speaking, about to speak, or expected to speak.

17. The system according to claim 1, wherein at least one of the at least first receiver is:

a bone conduction microphone, a receiver encapsulated in a closed enclosure, the enclosure further comprising air, a throat microphone or a head-mounted microphone, the head-mounted microphone being adapted, during use, to register sound propagating through a user's skull, a sound receiver located at or in a shielded or partly shielded cavity or semi-cavity of the user, a sound receiver or microphone located in an ear canal of the user, e.g. shielded from outside sound, and/or an accelerometer.

18. The system according to claim 1, wherein the second receiver is a vibration pickup or transducer or a bone conduction microphone configured to:

obtain vibrations propagating through the user, the vibrations being caused by the user speaking, by contact to the user, or obtain airborne vibrations where the airborne vibrations are caused by vibrations propagating through the user, the vibrations being caused by the user speaking.

19. The system according to claim 1, wherein:

the at least one first sound receiver is configured to register vibrations via contact to the user, and the at least one second sound receiver is a vibration pickup or transducer configured to obtain airborne vibrations where the airborne vibrations are caused by vibrations propagating through the user, the vibrations being caused by the user speaking.

20. The system according to claim 1, wherein the system further comprises:

a first sub-system comprising one of the at least one first sound receivers and one of the at least one second sound receivers, and a second sub-system comprising one of the at least one first sound receivers and one of the at least one second sound receivers.

21. A method of noise suppressing a sound signal in a noisy environment, the sound signal comprising speech of a user when the user is speaking, the method comprising the steps of:

obtaining a first sound signal by at least one first sound receiver wherein the at least one first sound receiver is a vibration pickup or transducer;

obtaining a second sound signal by at least one second sound receiver, wherein the first sound signal comprises a first airborne ambient noise signal from one or more ambient noise sources when noise is present and a first airborne speech signal when the user is speaking, and the second sound signal comprises a second airborne ambient noise signal from the one or more ambient noise sources when noise is present and a second airborne speech signal when the user is speaking;

obtaining an additional speech signal when the user is speaking by the at least one first sound receiver, wherein the additional speech signal is obtained directly or indirectly in response to vibrations propagating through the user, the vibrations being caused by the user speaking and the first sound signal further comprises the additional speech signal when the user is speaking;

dynamically deriving a relationship between the first sound signal and the second sound signal when the user is determined to not be speaking; and suppressing at least a part of the first airborne ambient noise signal, when present, in the first sound signal, the at least a part of the first airborne ambient noise signal being suppressed using the derived relationship between the first sound signal and the second sound signal.

22. The method according to claim 21, wherein the step of suppressing at least a part of the first airborne ambient noise signal includes using a filter to suppress the at least a part of the first airborne ambient noise signal.

23. The method according to claim 22, wherein the filter is an adaptive filter using the first sound signal and the second sound signal.

24. The method according to claim 22, wherein the filter filters the second sound signal using the derived relationship between the first sound signal and the second sound signal resulting in a filtered signal, and wherein the method further comprises removing or subtracting the filtered signal from the first sound signal.

25. The method according to claim 22, wherein the filter filters the first sound signal using the derived relationship between the first sound signal and the second sound signal resulting in a filtered signal, and wherein the method further comprises removing or subtracting the filtered signal from the second sound signal.

26. The method according to claim 22, wherein the filter is a static filter, where the static filter has a filter profile that has been determined previously and is stored accessibly to the method.

27. The method according to claim 22, wherein the method has access to one or more pre-determined filter profiles for the filter and wherein a given filter profile is selected and used from among the one or more pre-determined profiles depending on an automatic selection made in dependence on one or more of: a current registered sound level, noise type, a specific type of connected or used piece of equipment, whether a given connected and/or used piece of equipment has been turned off, whether a given user-worn connected and/or used piece of equipment has been removed, an available amount of power, or a user selection.

28. The method according to claim 21, wherein the derived relationship is a linear relationship.

29. The method according to claim 21, wherein the derived relationship is a non-linear relationship.

30. The method according to claim 21, wherein the derived relationship is a transfer function or an impulse response.

31. The method according to claim 21, further comprising locking the derived relationship when the user is speaking.

32. The method according to claim 21, wherein a rate of dynamically deriving the relationship is dependent on one or more selected from the group consisting of: an amount of available power, a level of the noise being above a predetermined threshold signifying a high level of noise, that a system using the method is plugged in for power, a degree of likelihood of whether speech is present, and that a battery of the system using the method is charged above a given threshold.

33. The method according to claim 21, wherein the method further comprises determining, by a voice activity detector, whether a user is speaking or not based on the additional voice signal.

34. The method according to claim 21, wherein a derived relationship between the first airborne ambient noise signal and the second airborne ambient noise signal is used instead of the derived relationship between the first sound signal and the second sound signal.

35. The method according to claim 21, wherein the method further comprises suppressing, during use, at least a part of the second airborne speech signal in addition to suppressing at least a part of the first airborne ambient noise signal.

36. The method according to claim 21, wherein the method further suppresses at least a part of the first airborne ambient noise signal, when present, in the first sound signal only when it is determined that the user is speaking, about to speak, and/or expected to speak.

37. The method according to claim 21, wherein at least one of the at least first receiver is:

a bone conduction microphone, a receiver encapsulated in a closed enclosure, the enclosure further comprising air, a throat microphone or a head-mounted microphone, the head-mounted microphone being adapted, during use, to register sound propagating through a user's skull, a sound receiver located at or in a shielded or partly shielded cavity or semi-cavity of the user, a sound receiver or microphone located in an ear canal of the user, e.g. shielded from outside sound, or an accelerometer.

38. The method according to claim 21, wherein the second receiver is a vibration pickup or transducer or a bone conduction microphone and the method further comprises:

obtaining vibrations, by the second receiver propagating through the user, the vibrations being caused by the user speaking, by contact to the user, or obtaining airborne vibrations where the airborne vibrations are caused by vibrations propagating through the user, the vibrations being caused by the user speaking.

39. The method according to claim 21, wherein:

the at least one first sound receiver is configured to register vibrations via contact to the user, and the at least one second sound receiver is a vibration pickup or transducer configured to obtain airborne vibrations where the airborne vibrations are caused by vibrations propagating through the user, the vibrations being caused by the user speaking.

* * * * *